US006073863A

United States Patent [19]

Wang

[11] Patent Number: 6,073,863

[45] Date of Patent: Jun. 13, 2000

[54] HOSE NOZZLE

[76] Inventor: Hsing-Fah Wang, 68 Mo Dan Lane, Jaw An Li, Lu Kang Township, Chan Hua Hsien, Taiwan

[21] Appl. No.: 09/307,859

[22] Filed: May 10, 1999

[51] Int. Cl.[7] ..... B05B 7/02

[52] U.S. Cl. ..... 239/525; 239/526; 239/530; 239/569; 239/577; 239/581.1

[58] Field of Search ..... 239/525, 526, 239/530, 569, 577, 581.1

[56] References Cited

U.S. PATENT DOCUMENTS 541,716 6/1895 Callahan ..... 239/581.1 X 2,753,219 7/1956 Matarese ..... 239/581.1 X 4,997,131 3/1991 Heren ..... 239/526 X

*Primary Examiner*—Andres Kashnikow

*Assistant Examiner*—Robin O. Evans

*Attorney, Agent, or Firm*—Harrison & Egbert

[57] ABSTRACT

A hose nozzle is formed of a main body, a control member and an actuating member. The main body is provided therein with a water duct, a channel and a water discharging tube. The flow of water moving through the water discharging tube is regulated by the control member which is actuated by the actuating member to rotate to various extends to regulate the amount of water that is allowed to pass through the control member.

1 Claim, 6 Drawing Sheets

HOSE NOZZLE

FIELD OF THE INVENTION

The present invention relates generally to a water sprinkling system, and more particularly to a hose nozzle.

BACKGROUND OF THE INVENTION

Conventional hose nozzles are generally incapable of controlling the amount of water that is ejected. However, there are certain conventional hose nozzles capable of regulating the amount of water that is ejected. These sophisticated hose nozzles are rather complicated in construction and are therefore not cost-effective.

SUMMARY OF THE INVENTION

The primary objective of the present invention is to provide an improved hose nozzle with a water control mechanism for regulating the amount of water that is ejected by the hose nozzle. The water control mechanism works in conjunction with an actuating member which is linked with the water control mechanism.

The objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
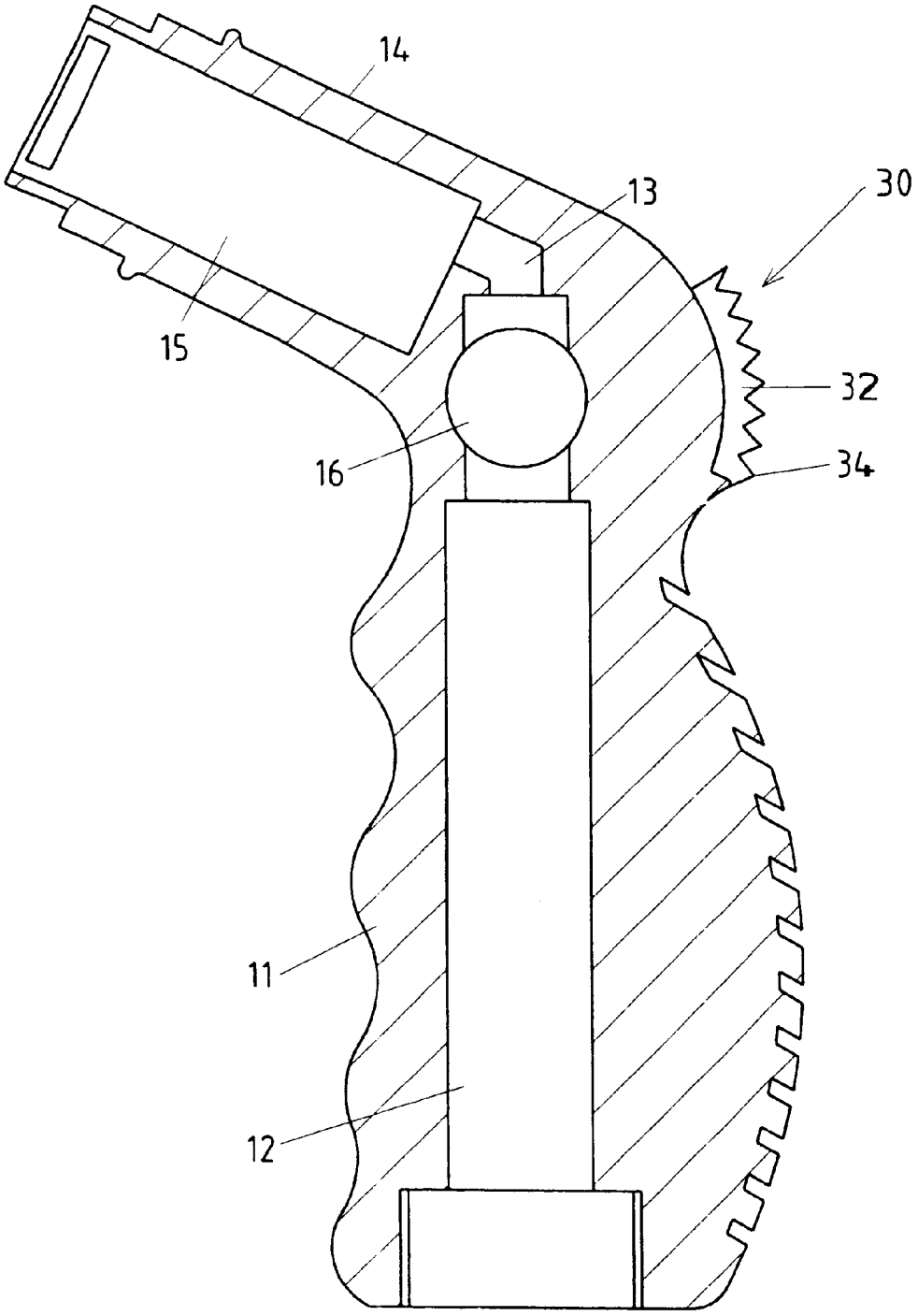
FIG. 1 shows a perspective view of the preferred embodiment of the present invention.
Figure 2:
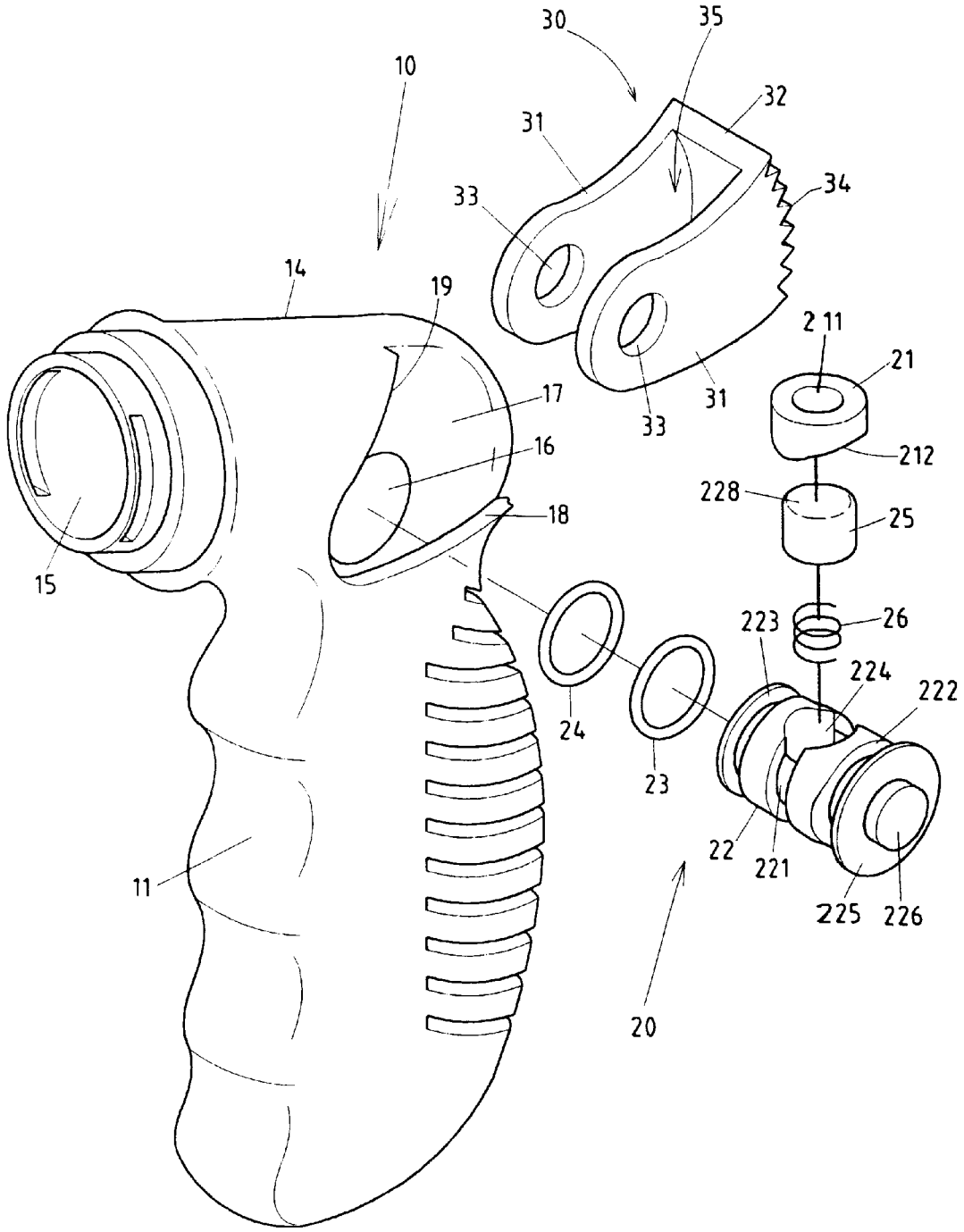
FIG. 2 shows an exploded view of the preferred embodiment of the present invention.
Figure 3:
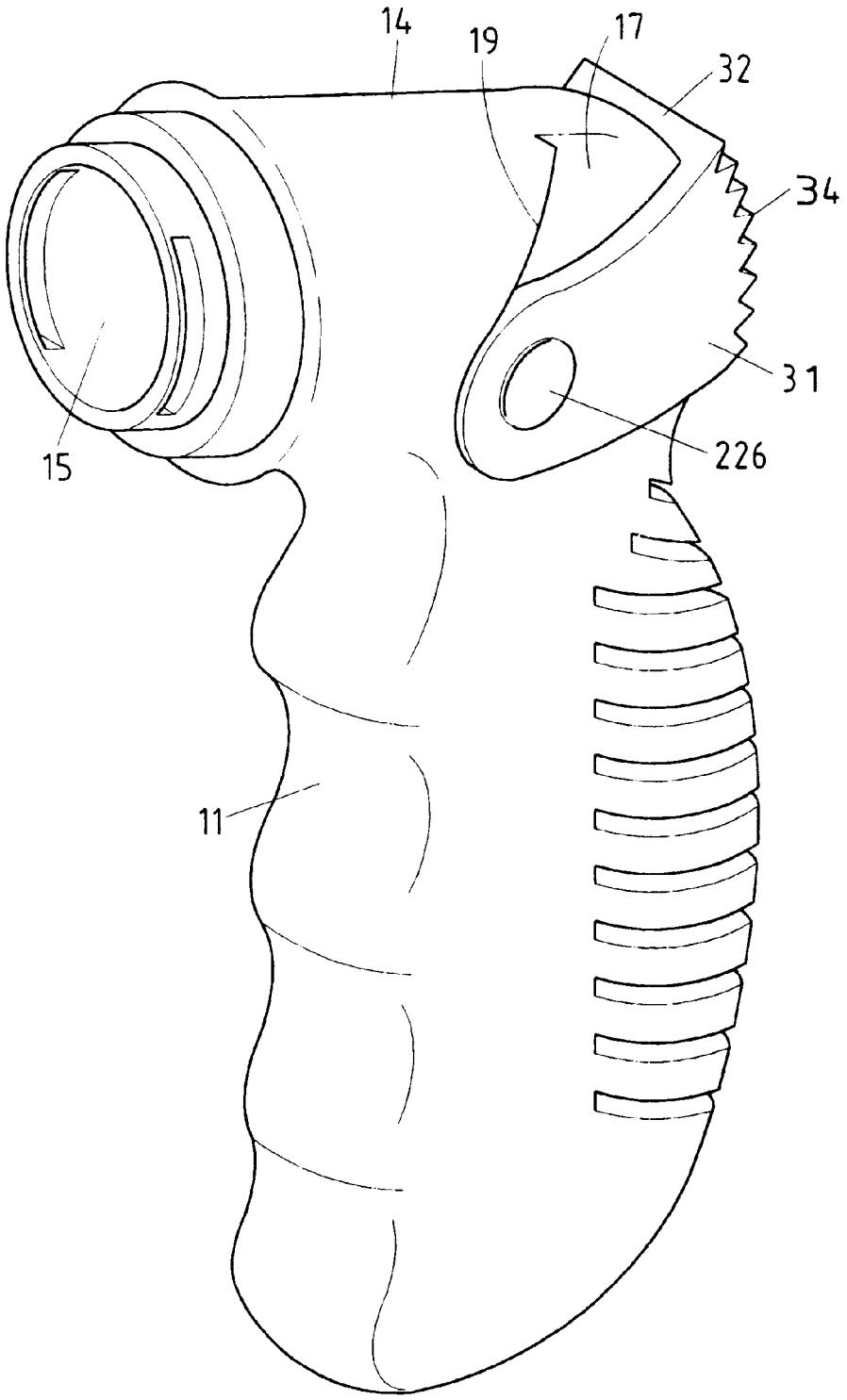
FIG. 3 shows a schematic view of the preferred embodiment of the present invention.
Figure 4:
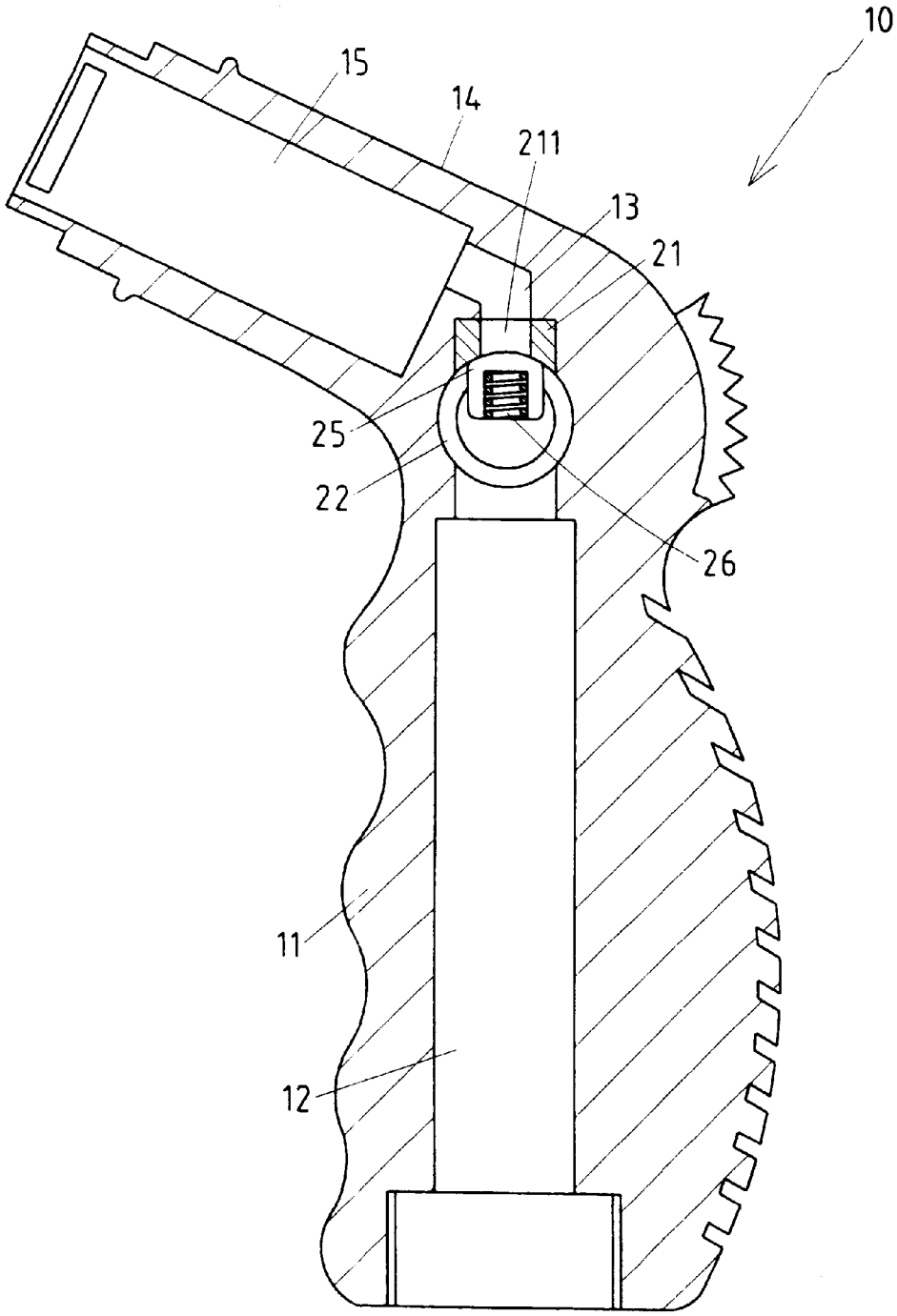
FIG. 4 shows a longitudinal sectional view of the preferred embodiment of the present invention.
Figure 5:
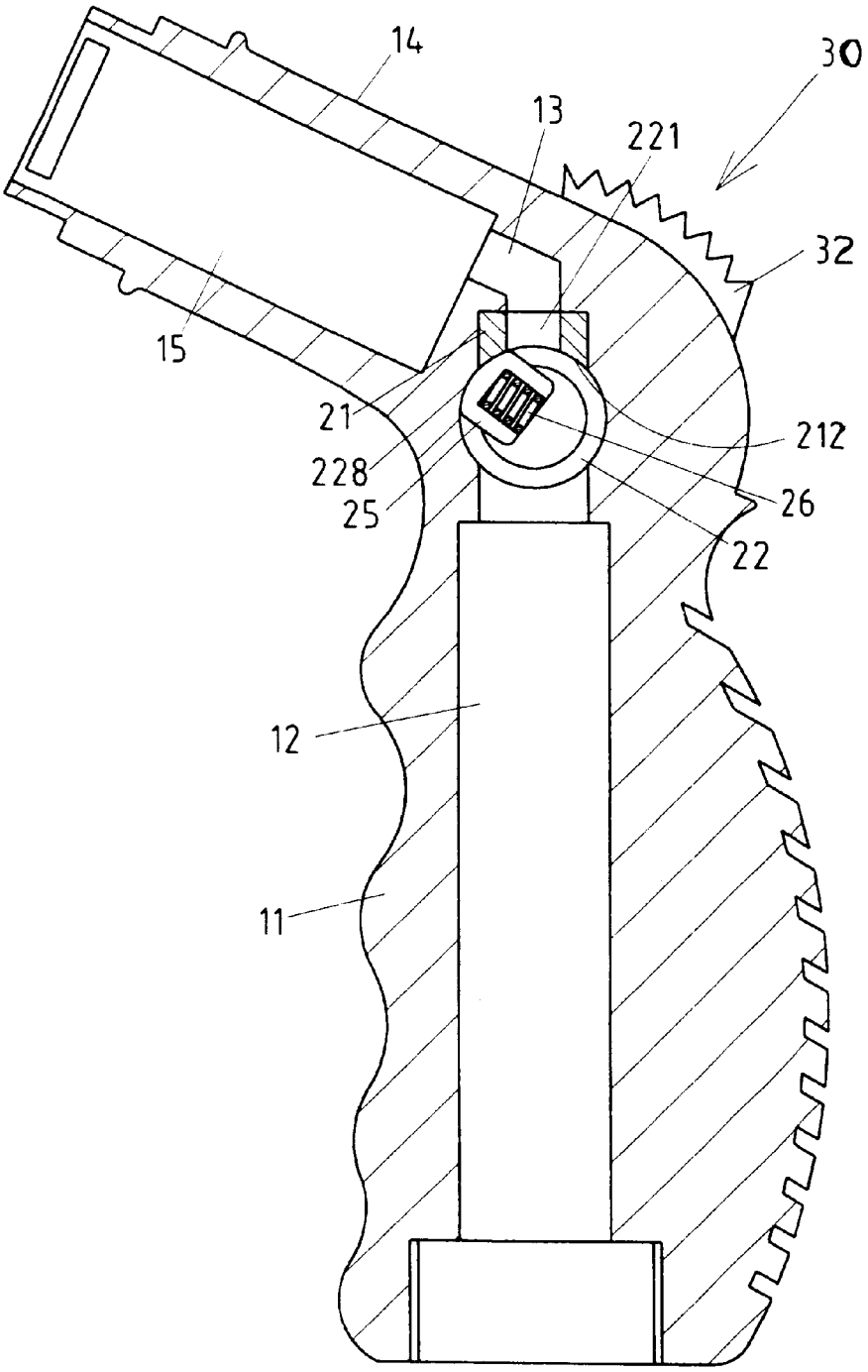
FIG. 5 shows another longitudinal sectional view of the preferred embodiment of the present invention.
Figure 6:
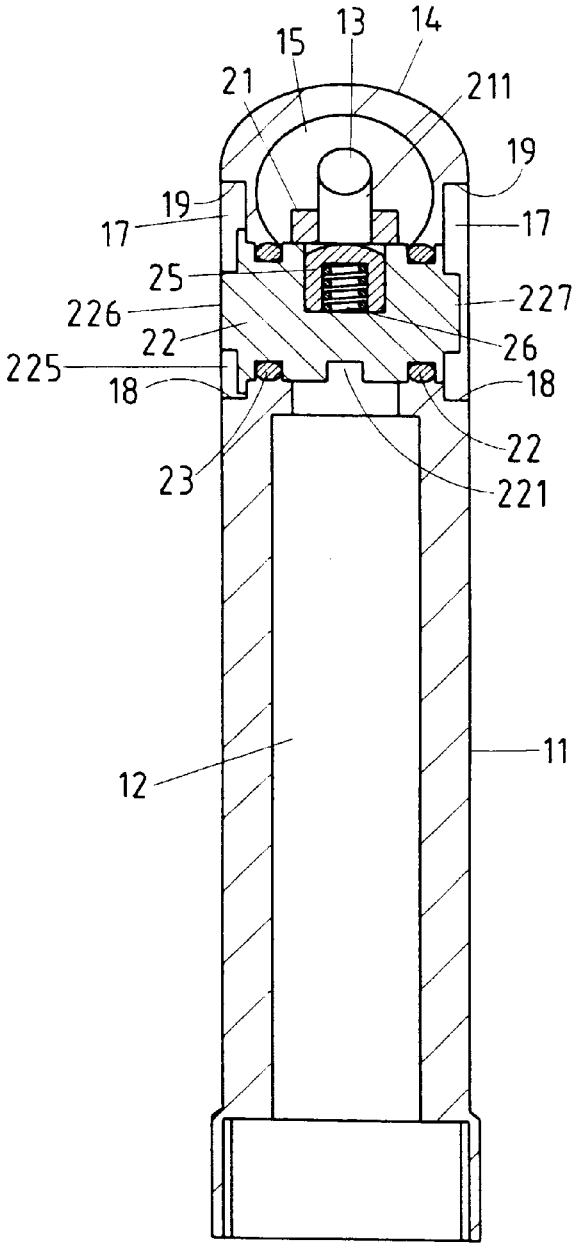
FIG. 6 shows a partial sectional view of the preferred embodiment of the present invention.

As shown in all drawings provided herewith, a hose nozzle embodied in the present invention comprises a main body 10, a control member 20, and an actuating member 30.

The main body 10 comprises a hand grip 11 in which a water duct 12 is located such that the water duct 12 is connected at the upper end thereof with a channel 13 smaller in diameter than the water duct 12. The channel 13 is connected at the end thereof with a water discharging tube 15 located in a spout end 14. Located at the junction of the hand grip 11 and the spout end 14 is a through hole 16. Two recessed portions 17 extend from the edges of both ends of the through hole 16 such that a stop edge 18 of the recessed portions 17 is located under the through hole 16, slanted edge 19 of the recessed portions 17 is located over the through hole 16.

The control member 20 is formed of a plug 21, a shaft 22, two washers 23 and 24, a water stopping piece 25, and a coiled spring 26. The plug 21 is provided with an axial hole 211 and an inclined bottom end 212. The plug 21 is disposed in the top end of the water duct 12 such that the plug 21 presses against the lower end of the channel 13, and that the water duct 12 is sealed off by the plug 21, and further that the axial hole 211 of the plug 21 is in communication with the water duct 12. The shaft 22 is inserted into the through hole 16 and is provided with the outer wall thereof with a middle circular groove 221 and two end circular grooves 222 and 223. The middle circular groove 221 is provided with a slot 224. The washer 23 is received in the end circular groove 222, whereas the washer 24 is received in the end circular groove 223. The shaft 22 is provided at one end thereof with a stop ring 225 greater in diameter than the shaft 22 and has in the outer side thereof a protrusion 226. The coiled spring 26 is disposed in the slot 224 such that the spring 26 is compressed by the water stopping piece 25. The shaft 22 is received in the through hole of the main body 10 such that the stop ring 225 is in contact with the recessed portion 17, and that the inclined top end 228 of the water stopping piece 25 is joined with the inclined bottom end 212 of the plug 21, and further that the plug 21 is urged by the elastic force of the spring 26 to seal off the axial hole 211 of the plug 21.

The actuating member 30 has two arms 31 and a shoulder 32. The two arms 31 are provided at the free end thereof with an engaging hole 33 dimensioned to receive the protrusions 226 of the shaft 22 of the control member 20. The shoulder 32 is provided in the outer side thereof with a serrated portion 34. Located between the two arms 31 is a receiving space 35. The actuating member 30 is joined with the main body 10 such that the recessed portions 17 are embraced by the two arms 31, and that the two protrusions 226 of the shaft 22 are engaged with the engaging holes 33 of the two arms 31 of the actuating member 30, and further that the bottom sides of the two arms 31 of the actuating member 30 are in an intimate contact with the stop edges 18 of the recessed portions 17 of the main body 10, and further that the upper sides of the two arms 31 of the actuating member 30 are kept apart from the slanted edges 19 of the recessed portions 17 of the main body 10.

In operation, the amount of water ejected by the hose nozzle of the present invention is controlled by pushing up the actuating member 30 so as to actuate the shaft 22 to turn, thereby resulting in the water stopping piece 25 to displace to open up the axial hole 211 of the plug 21. As a result, the water is ejected in a desired amount from the water discharging tube 15 via the water duct 12, the middle circular groove 221 of the shaft 22, the axial hole 211 of the plug 21, and the channel 13. In other words, the flow of the ejected water is regulated by the extent to which the shaft 22 is actuated by the actuating member 30 to rotate to regulate the size of the opening up of the axial hole 211 of the plug 21.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A hose nozzle comprising:

a main body composed of a hand grip, a water duct located in said hand grip, a channel connected at one end thereof with an upper end of said water duct, a spout end connected at one end thereof with said hand grip and provided therein with a water discharging tube which is connected with other end of said channel, said main body further composed of a through hole located at the junction of said hand grip and said spout end, and two recessed portions extending from edges of both ends of said through hole such that a stop edge of said recessed portions is located under said through hole, and that a slanted edge of said recessed portions is located over said through hole;

a control member formed of a plug, a shaft, two washers, a water stopping piece, and a coiled spring, said plug provided with an axial hole and an inclined bottom end and disposed in the top end of said water duct such that said plug presses against the lower end of said channel, and that said water duct is sealed off by said plug, and further that said axial hole of said plug is in communication with said water duct, said shaft being received in said through hole of said main body and provided in the outer wall thereof with a middle circular groove and two end circular grooves, said middle circular groove provided with a slot, said two washers being received respectively in said end circular grooves, said shaft provided at one end thereof with a stop ring greater in diameter than said shaft and having in the outer side thereof a protrusion, said coiled spring disposed in said slot such that said coiled spring is compressed by said water stopping piece, said shaft being received in said through hole of said main body such that said stop ring is in contact with said recessed portion, and that an inclined top end of said water stopping piece is joined with said inclined bottom end of said plug, and further that said plug is urged by the elastic force of said coiled spring to seal off said axial hole of said plug; and an actuating member having two arms and a shoulder, said two arms provided at a free end thereof with an engaging hole dimensioned to receive said protrusion of said shaft of said control member, said shoulder provided in the outer side thereof with a serrated portion, said actuating member being joined with said main body such that said recessed portions are embraced by said two arms, and that said protrusion of said shaft are engaged with said engaging holes of said two arms of said actuating member, and further that the bottom sides of said two arms of said actuating member are in an intimate contact with said stop edges of said recessed portions of said main body, and further that the upper sides of said two arms of said actuating member are kept apart from two slanted edges of said two recessed portions of said main body.

* * * * *